US009739120B2

(12) United States Patent
Murphree et al.

(10) Patent No.: US 9,739,120 B2
(45) Date of Patent: Aug. 22, 2017

(54) ELECTRICAL POWER STORAGE FOR DOWNHOLE TOOLS

(71) Applicant: HALLIBURTON ENERGY SERVICES, INC., Houston, TX (US)

(72) Inventors: Zachary R. Murphree, Dallas, TX (US); Michael L. Fripp, Carrollton, TX (US); Donald G. Kyle, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 793 days.

(21) Appl. No.: 13/948,278

(22) Filed: Jul. 23, 2013

(65) Prior Publication Data

US 2015/0027735 A1 Jan. 29, 2015

(51) Int. Cl.
*E21B 34/06* (2006.01)
*E21B 41/00* (2006.01)

(52) U.S. Cl.
CPC ..... *E21B 41/0085* (2013.01); *E21B 34/066* (2013.01)

(58) Field of Classification Search
CPC ..... E21B 41/0085; E21B 34/066
See application file for complete search history.

(56) References Cited

U.S. PATENT DOCUMENTS 2,189,936 A 8/1938 Broyles
2,189,937 A 2/1940 Broyles
2,308,004 A 1/1941 Hart
2,330,265 A 5/1941 Burt
2,381,929 A 8/1941 Schlumberger
2,372,006 A 12/1942 Baker
(Continued)

FOREIGN PATENT DOCUMENTS

WO 0220942 A1 3/2002
WO 2007071975 6/2007
(Continued)

OTHER PUBLICATIONS

Office Action dated Jul. 11, 2013 for U.S. Appl. No. 13/219,790, 40 pages.

(Continued)

*Primary Examiner* — Robert E Fuller
*Assistant Examiner* — David Carroll
(74) *Attorney, Agent, or Firm* — Locke Lord LLP

(57) ABSTRACT

A method of activating a downhole tool can include configuring the tool having an electrical power source, an electrical load, control circuitry which controls the electrical load, and a switch which selectively permits current flow between the power source and the circuitry, and generating electricity, thereby causing the switch to permit current flow between the power source and the circuitry. A downhole tool can include an electrical power source, an electrical load, control circuitry, a switch which selectively permits current flow between the power source and the circuitry, and a generator. Another method can include displacing a fluid and/or an object at the tool, generating electricity in response to the displacing, permitting current flow between an electrical power source and a control circuitry in response to the generating and, after the permitting and in response to detection of a predetermined signal, the circuitry causing activation of an electrical load.

19 Claims, 8 Drawing Sheets

(56) References Cited

U.S. PATENT DOCUMENTS 2,640,547 A 1/1948 Baker et al.
2,618,343 A 8/1948 Conrad
2,637,402 A 11/1948 Baker et al.
2,695,064 A 8/1949 Ragan et al.
3,029,873 A 7/1957 Hanes
3,055,430 A 6/1958 Campbell
2,961,045 A 11/1960 Stogner et al.
2,974,727 A 3/1961 Goodwin
3,122,728 A 2/1964 Lindberg
3,160,209 A 12/1964 Bonner
RE25,846 E 8/1965 Campbell
3,233,674 A 2/1966 Leutwyler
3,266,575 A 8/1966 Owen
3,398,803 A 8/1968 Leutwyler et al.
4,085,590 A 4/1978 Powell et al.
4,282,931 A 8/1981 Golben
4,352,397 A 10/1982 Christopher
4,377,209 A 3/1983 Golben
4,385,494 A 5/1983 Golben
4,402,187 A 9/1983 Golben
4,574,889 A 3/1986 Pringle
4,579,177 A 4/1986 Going, III
4,598,769 A 7/1986 Robertson
4,606,416 A 8/1986 Knighton et al.
4,884,953 A 12/1989 Golben
5,024,270 A 6/1991 Bostick
5,074,940 A 12/1991 Ochi et al.
5,101,907 A 4/1992 Schultz et al.
5,163,521 A * 11/1992 Pustanyk ..... E21B 7/04 175/107
5,197,758 A 3/1993 Lund et al.
5,211,224 A 5/1993 Bouldin
5,238,070 A 8/1993 Schultz et al.
5,249,630 A 10/1993 Meaders et al.
5,257,663 A 11/1993 Pringle et al.
5,285,204 A 2/1994 Sas-Jaworsky
5,316,081 A 5/1994 Baski et al.
5,316,087 A 5/1994 Manke et al.
5,396,951 A 3/1995 Ross
5,452,763 A 9/1995 Owen
5,476,018 A 12/1995 Nakanishi et al.
5,485,884 A 1/1996 Hanley et al.
5,531,270 A 7/1996 Fletcher et al.
5,531,845 A 7/1996 Flanigan et al.
5,573,307 A 11/1996 Wilkinson et al.
5,585,726 A 12/1996 Chau
5,666,050 A 9/1997 Bouldin et al.
5,673,556 A 10/1997 Goldben et al.
5,687,791 A 11/1997 Beck et al.
5,700,974 A 12/1997 Taylor
5,784,004 A 7/1998 Esfahani et al.
6,041,864 A 3/2000 Patel et al.
6,128,904 A 10/2000 Rosso, Jr. et al.
6,142,226 A 11/2000 Vick
6,150,601 A 11/2000 Schnatzmeyer et al.
6,152,232 A 11/2000 Webb et al.
6,167,974 B1 1/2001 Webb
6,186,226 B1 2/2001 Robertson
6,305,467 B1 10/2001 Connell et al.
6,315,043 B1 11/2001 Farrant et al.
6,343,649 B1 2/2002 Beck et al.
6,343,658 B2 2/2002 Webb
6,378,611 B1 4/2002 Helderle
6,536,524 B1 3/2003 Snider
6,557,637 B1 5/2003 Dore et al.
6,561,479 B1 5/2003 Eldridge
6,568,470 B2 5/2003 Goodson, Jr. et al.
6,598,679 B2 7/2003 Robertson
6,651,747 B2 11/2003 Chen et al.
6,659,186 B2 12/2003 Patel
6,684,950 B2 2/2004 Patel
6,695,061 B2 2/2004 Fripp et al.
6,705,425 B2 3/2004 West
6,776,255 B2 8/2004 West et al.
6,925,937 B2 8/2005 Robertson
6,962,215 B2 11/2005 Curtis et al.
6,971,449 B1 12/2005 Robertson
6,973,993 B2 12/2005 West et al.
6,988,556 B2 1/2006 Vick, Jr.
7,083,009 B2 8/2006 Paluch et al.
7,152,679 B2 12/2006 Simpson
7,191,672 B2 3/2007 Ringgenberg et al.
7,197,923 B1 4/2007 Wright et al.
7,237,616 B2 7/2007 Patel
7,395,882 B2 7/2008 Oldham et al.
7,413,011 B1 8/2008 Chee et al.
7,431,335 B2 10/2008 Khandhadia et al.
7,597,151 B2 10/2009 Curtis et al.
7,604,062 B2 10/2009 Murray
2003/0048697 A1 3/2003 Hirsch et al.
2004/0227509 A1 11/2004 Ucan
2006/0191687 A1 8/2006 Storm et al.
2006/0213669 A1 9/2006 Shipley et al.
2007/0079989 A1 4/2007 Bankston et al.
2007/0194947 A1* 8/2007 Huang ..... E21B 47/14 340/854.3
2008/0247273 A1 10/2008 Chemali et al.
2009/0308588 A1 12/2009 Howell et al.
2011/0057449 A1 3/2011 Marya et al.
2011/0240311 A1 10/2011 Robison et al.
2011/0265987 A1* 11/2011 Wright ..... E21B 34/063 166/154
2011/0284240 A1 11/2011 Chen et al.
2013/0026978 A1* 1/2013 Cooley ..... H01M 10/052 320/107
2014/0352981 A1* 12/2014 Fripp ..... E21B 41/0085 166/381

FOREIGN PATENT DOCUMENTS

WO 2010079327 A1 7/2010
WO 2011004180 1/2011
WO 2013016145 1/2013

OTHER PUBLICATIONS

Office Action dated Feb. 21, 2014 for U.S. Appl. No. 13/219,790, 33 pages.
Office Action dated Feb. 10, 2005 for U.S. Appl. No. 10/426,917, 6 pages.
Office Action dated Mar. 1, 2007 for U.S. Appl. No. 11/180,140, 9 pages.
Office Action dated Sep. 17, 2007 for U.S. Appl. No. 11/180,140, 8 pages.
Office Action dated Feb. 26, 2009 for U.S. Appl. No. 11/180,140, 7 pages.
Office Action dated Sep. 9, 2008 for U.S. Appl. No. 11/180,140, 12 pages.
Office Action dated Oct. 27, 2008 for U.S. Appl. No. 11/180,140, 11 pages.
Office Action dated Feb. 10, 2009 for U.S. Appl. No. 10/426,917, 11 pages.
Specification and Drawings for U.S. Appl. No. 13/539,392, filed Nov. 8, 2009, 47 pages.
Specification and Drawings for U.S. Appl. No. 12/831,240, filed Jul. 6, 2010, 65 pages.
Specification and Drawings for U.S. Appl. No. 12/962,621, filed Dec. 10, 2010, 32 pages.
Specification and Drawings for U.S. Appl. No. 13/219,790, filed Aug. 29, 2011, 49 pages.
Specification and Drawings for U.S. Appl. No. 13/440,727, filed Apr. 5, 2012, 53 pages.
Specification and Drawings for U.S. Appl. No. 13/025,039, filed Feb. 10, 2011, 69 pages.
Specification and Drawings for U.S. Appl. No. 13/025,041, filed Feb. 10, 2011, 71 pages.
Specification and Drawings for U.S. Appl. No. 13/151,457, filed Jun. 2, 2011, 78 pages.
Specification and Drawings for U.S. Appl. No. 13/948,267, filed Jul. 23, 2013, 38 pages.

(56) References Cited

OTHER PUBLICATIONS

Weatherford; "Underbalanced Drilling: Undeniable Success", product article, dated Mar. 2002, 1 page.
International Search Report and Written Opinion dated Mar. 11, 2013 for PCT Application No. PCT/US2012/050762, 14 pages.
International Search Report and Written Opinion dated May 30, 2013 for PCT Patent Application No. PCT/ US2013/029750, 18 pages.
International Search Report and Written Opinion dated Jul. 23, 2013 for PCT Patent Application No. PCT/US2013/029762, 14 pages.
Search Report dated Jun. 23, 2011 for International Patent Application Serial No. PCT/US10/61047, 5 pages.
Written Opinion dated Jun. 23, 2011 for International Patent Application Serial No. PCT/US10/61047, 4 pages.
International Preliminary Report on Patentability and Written Opinion issued for International Patent Application No. PCT/US06/023947 dated Jan. 24, 2008, 6 pages.
Anonymous; "Smart Plugging Tool System for Selectively Actuating Wellbore Valves", originally published in Prior Art Database, dated Jan. 7, 2008, 5 pages.
Crabb, James, et al.; Patent Application and Drawings entitled, "Packing Element System with Profiled Surface", filed Jul. 6, 2010, U.S. Appl. No. 12/831,240, 65 pages.
Glidden, Steven C., "Solid State Spark Gap Replacement Switches", 2006, 4 pages.
Halliburton; "Horizontal Completion Systems", article H03280, received Jun. 30, 2011, 14 pages.
Halliburton; "Quick Trip Valve", article H02856R, dated Apr. 2002, 2 pages.
Halliburton; "Delta Stim Sleeve", article H04616, dated Sep. 2008, 4 pages.
Halliburton; "RapidFrac System", H08004, dated Oct. 2011, 3 pages.
Halliburton; "RapidFrac System", product presentation, dated 2011, 6 pages.
Halliburton; "Delta Stim Lite Sleeve", article H06033, dated Jun. 2010, 3 pages.
Mide, "Volture Piezoelectric Energy Harvesters", data sheet, dated Jan. 23, 2013, 24 pages.
Miller, Scott L.; Patent Application and Drawings entitled, "Gas Generator for Pressurizing Downhole Samples", filed Dec. 10, 2010, U.S. Appl. No. 12/962,621, 32 pages.
Pes; "Model DV Dual Control Line Operated Drill Through Lubricator Valve", company document, dated Jul. 27, 2001, 6 pages.
Weatherford, "A Year of Milestones for Your Company", annual report, dated 2002, 7 pages.
Weatherford; "Products and Services Catalog", brochure # 01.01, dated 2002, 3 pages.
Wikipedia, "Thermoelectric Effect", online article, dated Jun. 12, 2013, 10 pages.
International Search Report with Written Opinion dated Oct. 27, 2014 for PCT Patent Application No. PCT/US2014/045775, 12 pages.
EPO Search Report dated Dec. 23, 2016 in corresponding Application 14830274.8-1610 / 2994593 PCT/US2014045775.

* cited by examiner

ELECTRICAL POWER STORAGE FOR DOWNHOLE TOOLS

BACKGROUND

This disclosure relates generally to equipment utilized and operations performed in conjunction with a subterranean well and, in an example described below, more particularly provides for long term electrical power storage in downhole tools.

It is known to store electrical power downhole in batteries. The batteries may be used to operate electronic circuitry of a downhole tool. In order to conserve the electrical power while the electronic circuitry is not being actively used in operation of the tool, the electronic circuitry can be placed in "sleep" mode.

Unfortunately, the electronic circuitry continues to consume electrical power, even while in sleep mode. For example, the electronic circuitry may need to receive and process measurements made by a sensor, in order to detect when the electronic circuitry should "awaken" from the sleep mode. This electrical power consumption by the electronic circuitry in the sleep mode can significantly reduce the stored electrical power over long periods of time.

Therefore, for the above reasons and others, it will be appreciated that improvements are continually needed in the art of providing long term electrical power storage for downhole tools. Such improvements can be useful whether or not batteries are used for downhole electrical power storage, and whether or not any circuitry is awaken from a sleep mode, etc.

DETAILED DESCRIPTION

Figure 1:
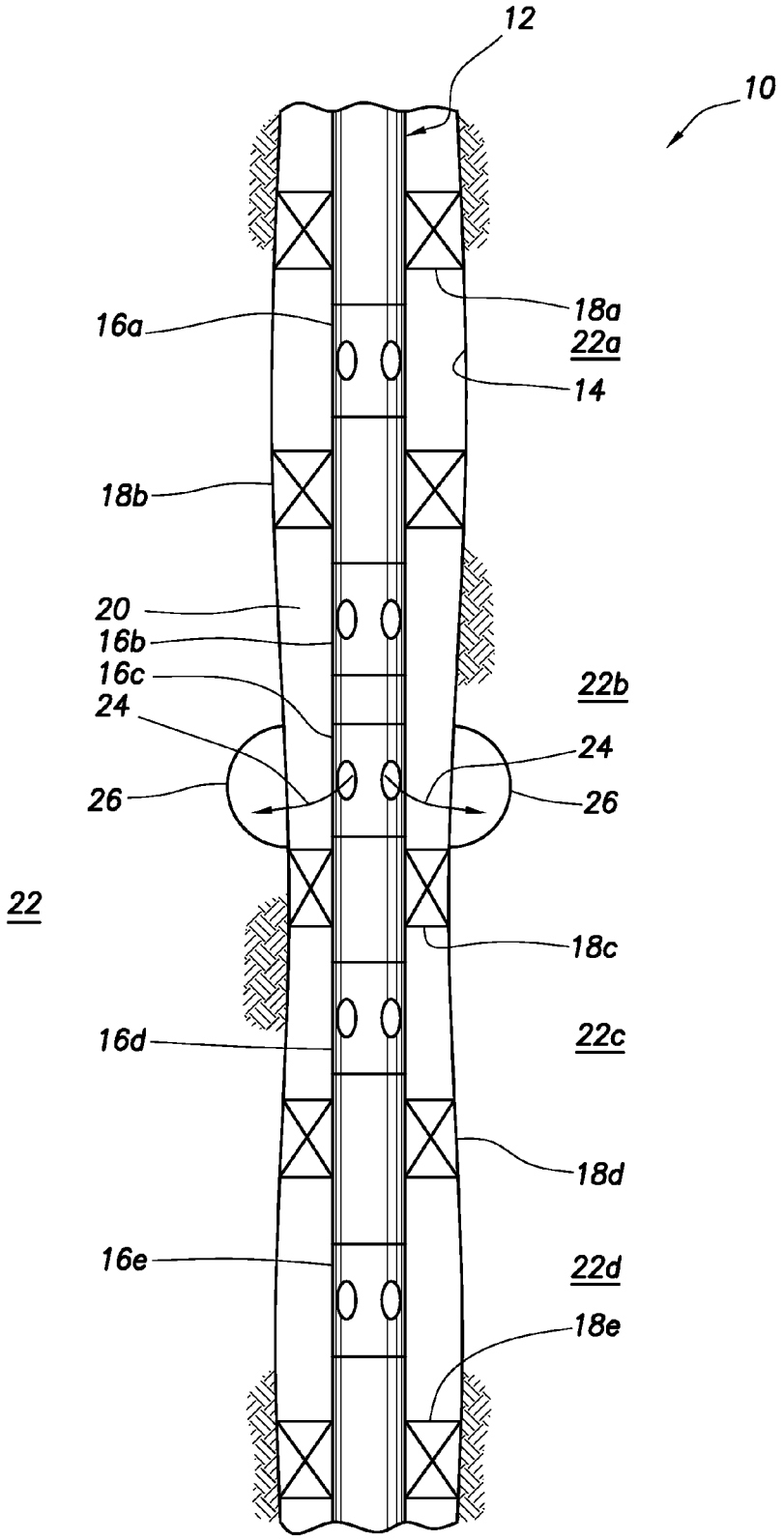
FIG. 1 is a representative partially cross-sectional view of a well system and associated method which can embody principles of this disclosure.

Representatively illustrated in FIG. 1 is a system 10 for use with a well, and an associated method, which can embody principles of this disclosure. In this example, a tubular string 12 is positioned in a wellbore 14, with the tubular string having multiple downhole tools 16*a-e*, 18*a-e* interconnected therein. In this example, the downhole tools 16*a-e* are injection valves, and the downhole tools 18*a-e* are packers, but other types of downhole tools (such as, samplers, completion tools, data gathering tools, etc.) can incorporate the principles of this disclosure.

The tubular string 12 may be of the type known to those skilled in the art as casing, liner, tubing, a production string, a work string, a drill string, etc. Any type of tubular string may be used and remain within the scope of this disclosure.

The packers 18*a-e* seal off an annulus 20 formed radially between the tubular string 12 and the wellbore 14. The packers 18*a-e* in this example are designed for sealing engagement with an uncased or open hole wellbore 14, but if the wellbore is cased or lined, then cased hole-type packers may be used instead. Swellable, inflatable, expandable and other types of packers may be used, as appropriate for the well conditions, or no packers may be used (for example, the tubular string 12 could be expanded into contact with the wellbore 14, the tubular string could be cemented in the wellbore, etc.).

In the FIG. 1 example, the injection valves 16*a-e* permit selective fluid communication between an interior of the tubular string 12 and each section of the annulus 20 isolated between two of the packers 18*a-e*. Each section of the annulus 20 is in fluid communication with a corresponding earth formation zone 22*a-d*. Of course, if packers 18*a-e* are not used, then the injection valves 16*a-e* can otherwise be placed in communication with the individual zones 22*a-d*, for example, with perforations, etc.

The zones 22*a-d* may be sections of a same formation 22, or they may be sections of different formations. Each zone 22*a-d* may be associated with one or more of the injection valves 16*a-e*.

In the FIG. 1 example, two injection valves 16*b,c* are associated with the section of the annulus 20 isolated between the packers 18*b,c*, and this section of the annulus is in communication with the associated zone 22*b*. It will be appreciated that any number of injection valves may be associated with a zone.

It is sometimes beneficial to initiate fractures 26 at multiple locations in a zone (for example, in tight shale formations, etc.), in which cases the multiple injection valves can provide for injecting fluid 24 at multiple fracture initiation points along the wellbore 14. In the example depicted in FIG. 1, the valve 16*c* has been opened, and fluid 24 is being injected into the zone 22*b*, thereby forming the fractures 26.

Preferably, the other valves 16*a,b,d,e* are closed while the fluid 24 is being flowed out of the valve 16*c* and into the zone 22*b*. This enables all of the fluid 24 flow to be directed toward forming the fractures 26, with enhanced control over the operation at that particular location.

However, in other examples, multiple valves 16*a-e* could be open while the fluid 24 is flowed into a zone of an earth formation 22. In the well system 10, for example, both of the valves 16*b,c* could be open while the fluid 24 is flowed into the zone 22*b*. This would enable fractures to be formed at multiple fracture initiation locations corresponding to the open valves.

It will, thus, be appreciated that it would be beneficial to be able to open different sets of one or more of the valves 16*a-e* at different times. For example, one set (such as valves 16*b,c*) could be opened at one time (such as, when it is desired to form fractures 26 into the zone 22*b*), and another set (such as valve 16*a*) could be opened at another time (such as, when it is desired to form fractures into the zone 22*a*).

One or more sets of the valves 16*a-e* could be open simultaneously. However, it is generally preferable for only one set of the valves 16*a-e* to be open at a time, so that the fluid 24 flow can be concentrated on a particular zone, and so flow into that zone can be individually controlled.

At this point, it should be noted that the well system 10 and method are described herein and depicted in the drawings as merely one example of a wide variety of possible systems and methods which can incorporate the principles of this disclosure. Therefore, it should be understood that those principles are not limited in any manner to the details of the system 10 or associated method, or to the details of any of the components thereof (for example, the tubular string 12, the wellbore 14, the valves 16*a-e*, the packers 18*a-e*, etc.).

It is not necessary for the wellbore 14 to be vertical as depicted in FIG. 1, for the wellbore to be uncased, for there to be five each of the valves 16*a-e* and packers, for there to be four of the zones 22*a-d*, for fractures 26 to be formed in the zones, for the fluid 24 to be injected, etc. The fluid 24 could be any type of fluid which is injected into an earth formation, e.g., for stimulation, conformance, acidizing, fracturing, water-flooding, steam-flooding, treatment, gravel packing, cementing, or any other purpose. Thus, it will be appreciated that the principles of this disclosure are applicable to many different types of well systems and operations.

In other examples, the principles of this disclosure could be applied in circumstances where fluid is not only injected, but is also (or only) produced from the formation 22. In these examples, the fluid 24 could be oil, gas, water, etc., produced from the formation 22. Thus, well tools other than injection valves can benefit from the principles described herein.

Figure 2A:
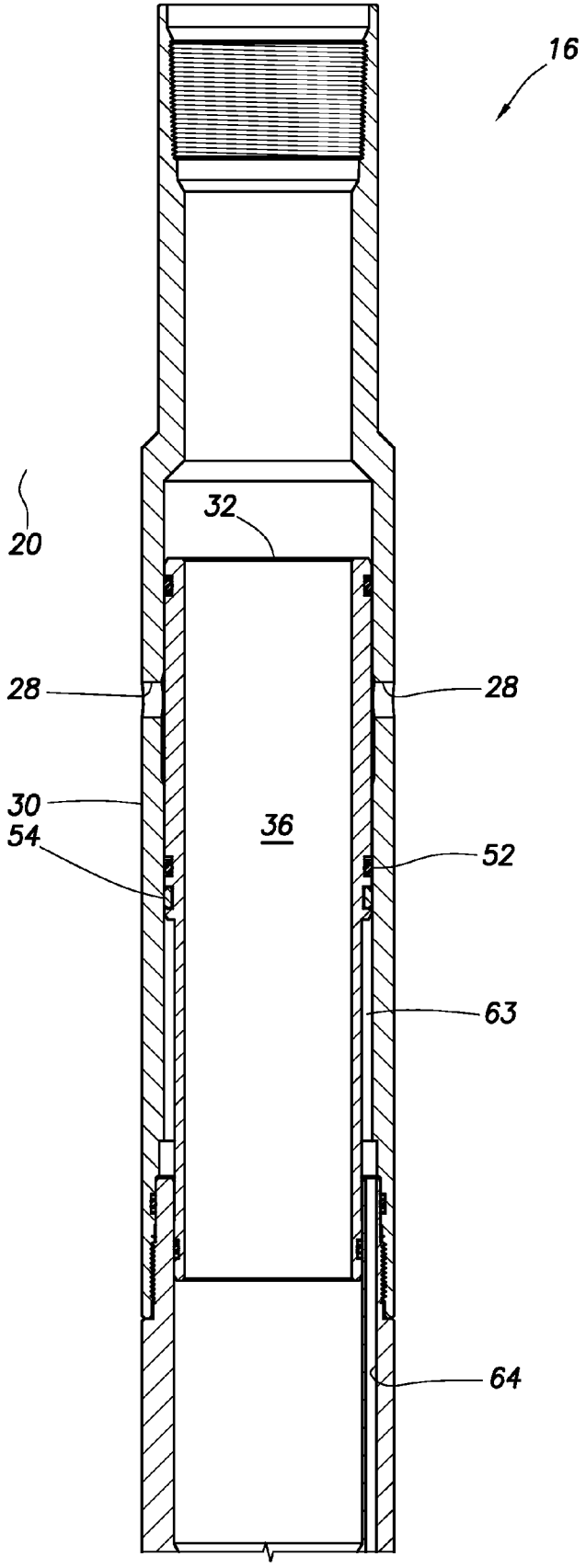
FIGS. 2A & B are representative cross-sectional views of successive axial sections of a downhole tool that may be used in the system and method of claim 1, and which can embody principles of this disclosure.
Figure 2B:
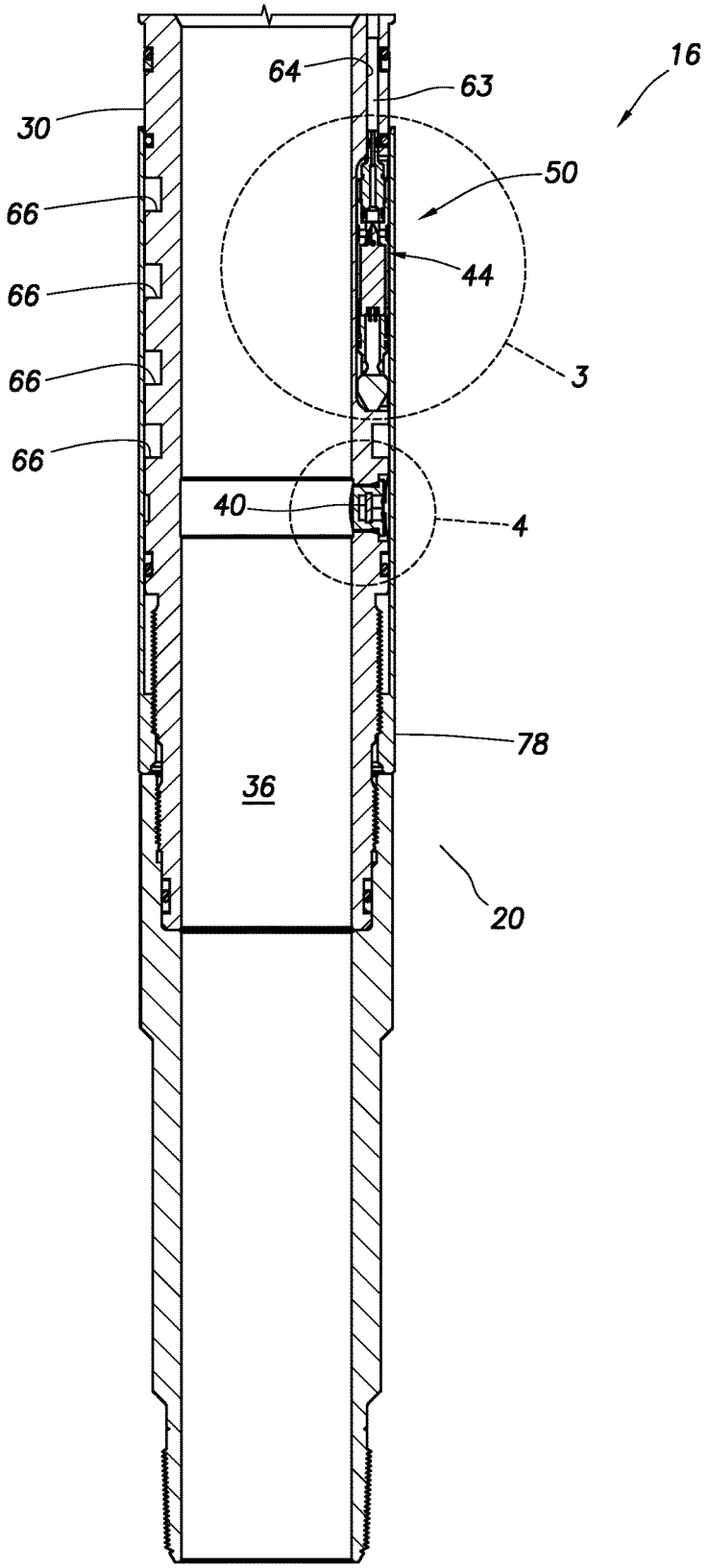
Figure 3:
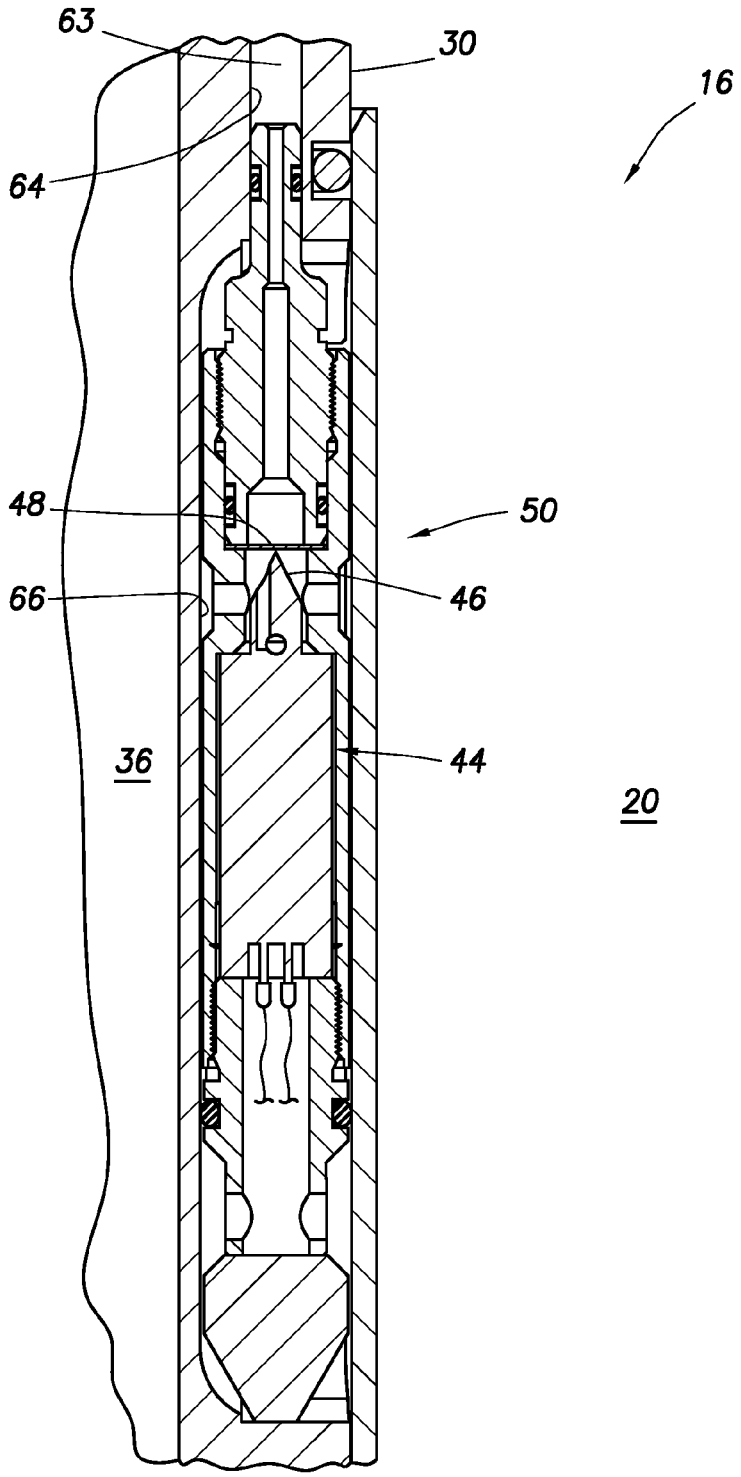
FIG. 3 is a representative cross-sectional view of an actuator of the downhole tool.
Figure 4:
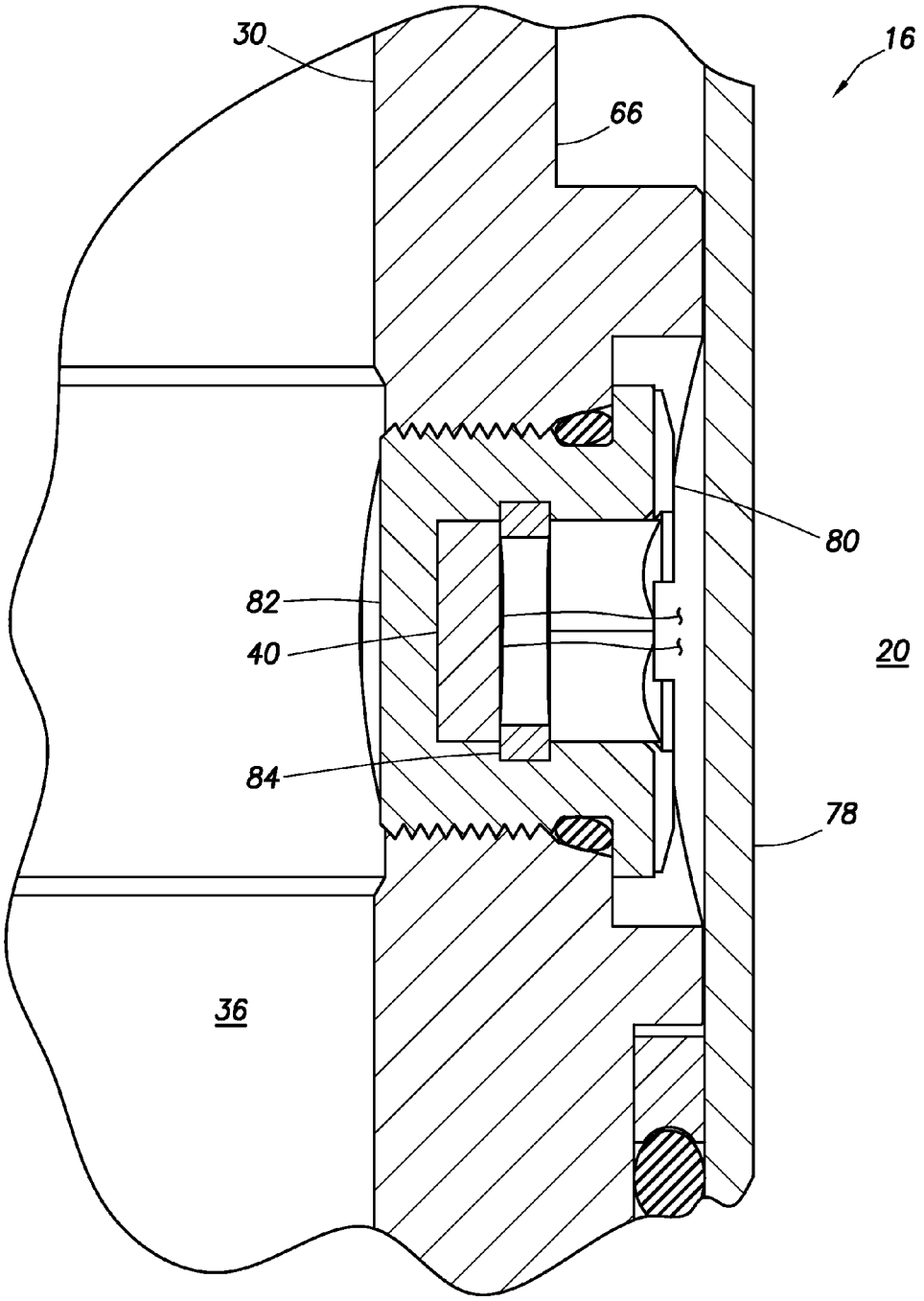
FIG. 4 is a representative cross-sectional view of a sensor of the downhole tool.

Referring additionally now to FIGS. 2A-4, an example of an injection valve 16 is representatively illustrated. In FIGS. 2A & B, the valve 16 is depicted in a closed configuration. FIG. 3 depicts an enlarged scale view of an actuator 50 of the valve 16. FIG. 4 depicts an enlarged scale view of a sensor 40 of the valve.

In FIGS. 2A & B, it may be seen that a support fluid 63 is contained in a chamber 64, which extends as a passage to the actuator 50. In addition, a chamber 66 comprises multiple annular recesses extending about a housing 30. A sleeve 78 isolates the chamber 66 and actuator 50 from well fluid in the annulus 20.

In FIG. 3, a manner in which a pressure barrier 48 isolates the chamber 64 from the chamber 66 can be more clearly seen. When a valve device 44 is activated, a piercing member 46 pierces the pressure barrier 48, allowing the support fluid 63 to flow from the chamber 64 to the chamber 66 in which the valve device 44 is located.

Initially, the chamber 66 is at or near atmospheric pressure, and contains air or an inert gas. Thus, the support fluid 63 can readily flow into the chamber 66, allowing a sleeve 32 to displace downwardly, due to a pressure differential across a piston 52.

In FIG. 4, a manner in which the sensor 40 can positioned for detecting magnetic fields and/or magnetic field changes in a flow passage 36 extending longitudinally through the valve 16 can be clearly seen. In this example, the magnetic sensor 40 is mounted in a plug 80 secured in the housing 30 in close proximity to the passage 36.

The magnetic sensor 40 is preferably separated from the flow passage 36 by a pressure barrier 82 having a relatively low magnetic permeability. The pressure barrier 82 may be integrally formed as part of the plug 80, or the pressure barrier could be a separate element, etc.

Suitable low magnetic permeability materials for the pressure barrier 82 can include Inconel and other high nickel and chromium content alloys, stainless steels (such as, 300 series stainless steels, duplex stainless steels, etc.). Inconel alloys have magnetic permeabilities of about $1\times10^{-6}$, for example. Aluminum (magnetic permeability $\sim1.26\times10^{-6}$), plastics, composites (e.g., with carbon fiber, etc.) and other nonmagnetic materials may also be used.

One advantage of making the pressure barrier 82 out of a low magnetic permeability material is that the housing 30 can be made of a relatively low cost high magnetic permeability material (such as steel, having a magnetic permeability of about $9\times10^{-4}$, for example), but magnetic fields produced by a magnetic device 38 (not shown in FIG. 4, see FIG. 7) in the passage 36 can be detected by the magnetic sensor 40 through the pressure barrier. That is, magnetic flux can readily pass through the relatively low magnetic permeability pressure barrier 82 without being significantly distorted.

In some examples, a relatively high magnetic permeability material 84 may be provided proximate the magnetic sensor 40 and/or pressure barrier 82, in order to focus the magnetic flux on the magnetic sensor. A permanent magnet (not shown) could also be used to bias the magnetic flux, for example, so that the magnetic flux is within a linear range of detection of the magnetic sensor 40.

In some examples, the relatively high magnetic permeability material 84 surrounding the sensor 40 can block or shield the sensor from other magnetic fields, such as, due to magnetism in the earth surrounding the wellbore 14. The material 84 allows only a focused window for magnetic fields to pass through, and only from a desired direction. This has the benefit of preventing other undesired magnetic fields from contributing to the sensor 40 output.

When the actuator 50 is actuated, the piercing member pierces the pressure barrier 48, thereby allowing the support fluid 63 to flow into the chamber 66, and allowing the sleeve 32 to displace downward due to a pressure differential across the piston 52. When the sleeve displaces downward, openings 28 in the housing are unblocked, thereby permitting fluid flow between the annulus 20 and the passage 36.

A locking device 54 (for example, a snap ring) can be used to prevent subsequent upward displacement of the sleeve 32. In other examples, it may be desired to close the valve 16 after it has been opened. In those examples, the locking device 54 may not be used, or it may be releasable.

Note that the valve 16 is depicted in the drawings and described herein as merely one example of a downhole tool that can embody principles of this disclosure. Other examples of valves that can embody the principles of this disclosure are described in U.S. patent application Ser. No. 13/440,823.

Packers 18*a-e* and other types of downhole tools can embody this disclosure's principles. Other downhole tools can be activated by permitting current flow between an electrical power source and an electrical load of any type. Therefore, the scope of this disclosure is not limited to the details of the valve 16, or to any particular type of downhole tool.

Figure 5:
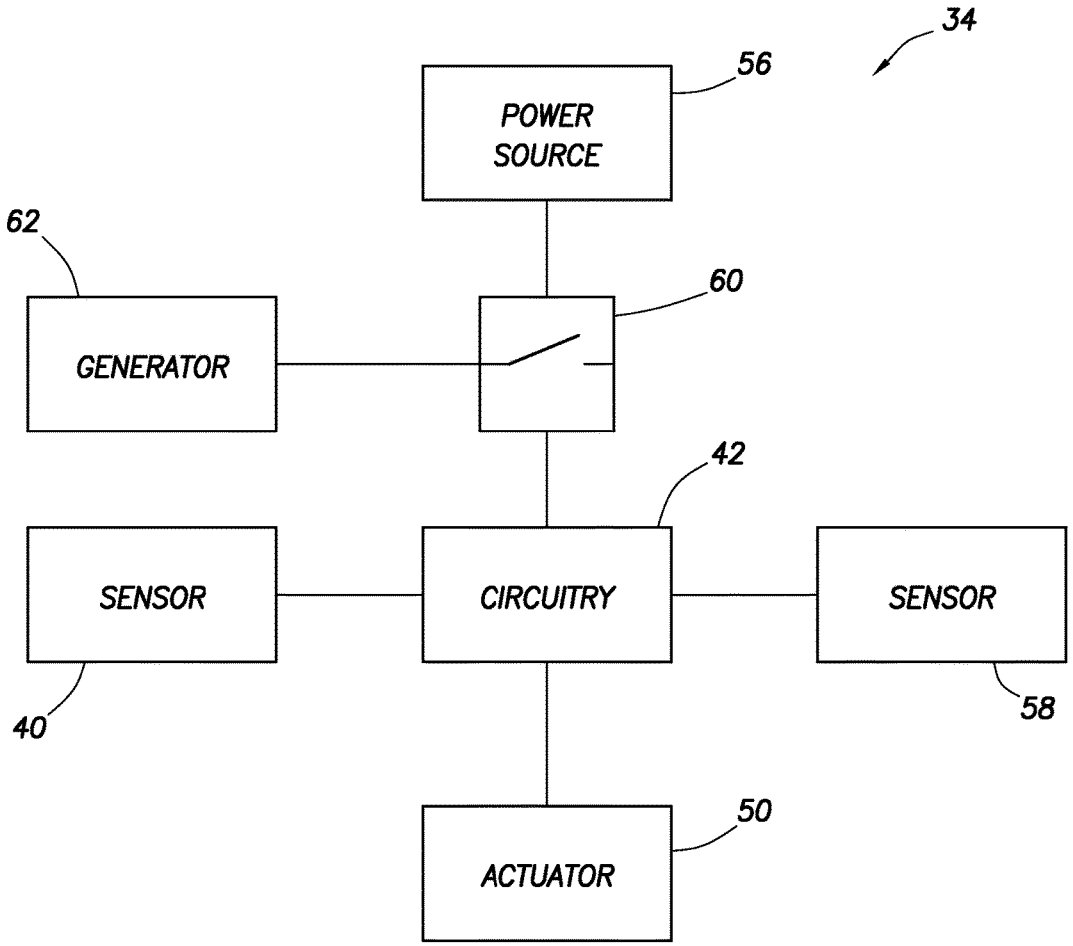
FIG. 5 is a representative schematic view of a control system of the downhole tool.

Referring additionally now to FIG. 5, a schematic diagram of a control system 34 for the valve 16 is representatively illustrated. The control system 34 may be entirely incorporated into the valve 16, or portions of the control system could be separate from the valve. The control system 34 could be used with other types of downhole tools in other examples.

The control system 34 as depicted in FIG. 5 includes control circuitry 42, for example, one or more processors, memory devices (programmable, volatile and/or non-volatile), signal conditioners, etc. The main function of the circuitry 42 in this example is to determine when the actuator 50 should be actuated.

At an appropriate time, the circuitry 42 delivers electrical power from an electrical power source 56, such as, batteries, a charged capacitor, etc., to actuate the actuator 50. In other examples, the circuitry 42 may permit electrical current flow between the power source 56 and another type of electrical load (such as, a data gathering device, a heater, etc.).

In the FIG. 5 example, the sensor 40 is connected to the circuitry 42 for determining when the actuator 50 should be actuated. For example, a particular type or pattern of magnetic field, and/or a certain number of magnetic fields, may be detected by the sensor 40 and, in response, the circuitry 42 can cause the electrical power to be delivered to the actuator 50.

Another (optional) sensor 58 can be used for determining whether the actuator 50 should be actuated. For example, the sensor 58 could sense pressure so that, unless the valve 16 is positioned downhole (e.g., exposed to a pressure of at least, say, 500 psi), the circuitry 42 will not cause the actuator 50 to actuate. Any number and/or type of sensors may be used for determining whether and when the actuator 50 should be actuated, in keeping with the principles of this disclosure.

However, in this example, the circuitry 42 is not continuously monitoring outputs of the sensors 40, 58, and is not in a "sleep" mode, during most of its presence downhole. Instead, a switch 60 is used to selectively permit current flow between the power source 56 and the circuitry 42, in response to generation of electricity downhole by a generator 62. In this manner, the control system 34 does not consume electrical power during most of its presence downhole and, thus, the electrical power is conserved.

The generator 62 is caused to generate electricity when it is desired for the circuitry 42 to begin monitoring the sensor 40 and/or sensor 58. For example, the switch 60 would be "off" as the tubular string 12 of FIG. 1 is installed, the packers 18*a-e* are set, perforations are formed, etc. Then, when it is desired to begin the process of forming fractures 26, the circuitry 42 can be activated by turning the switch 60 "on," so that the circuitry can begin monitoring the sensor(s) 40/58 to determine whether and when the valve 16 should be opened.

Figure 6:
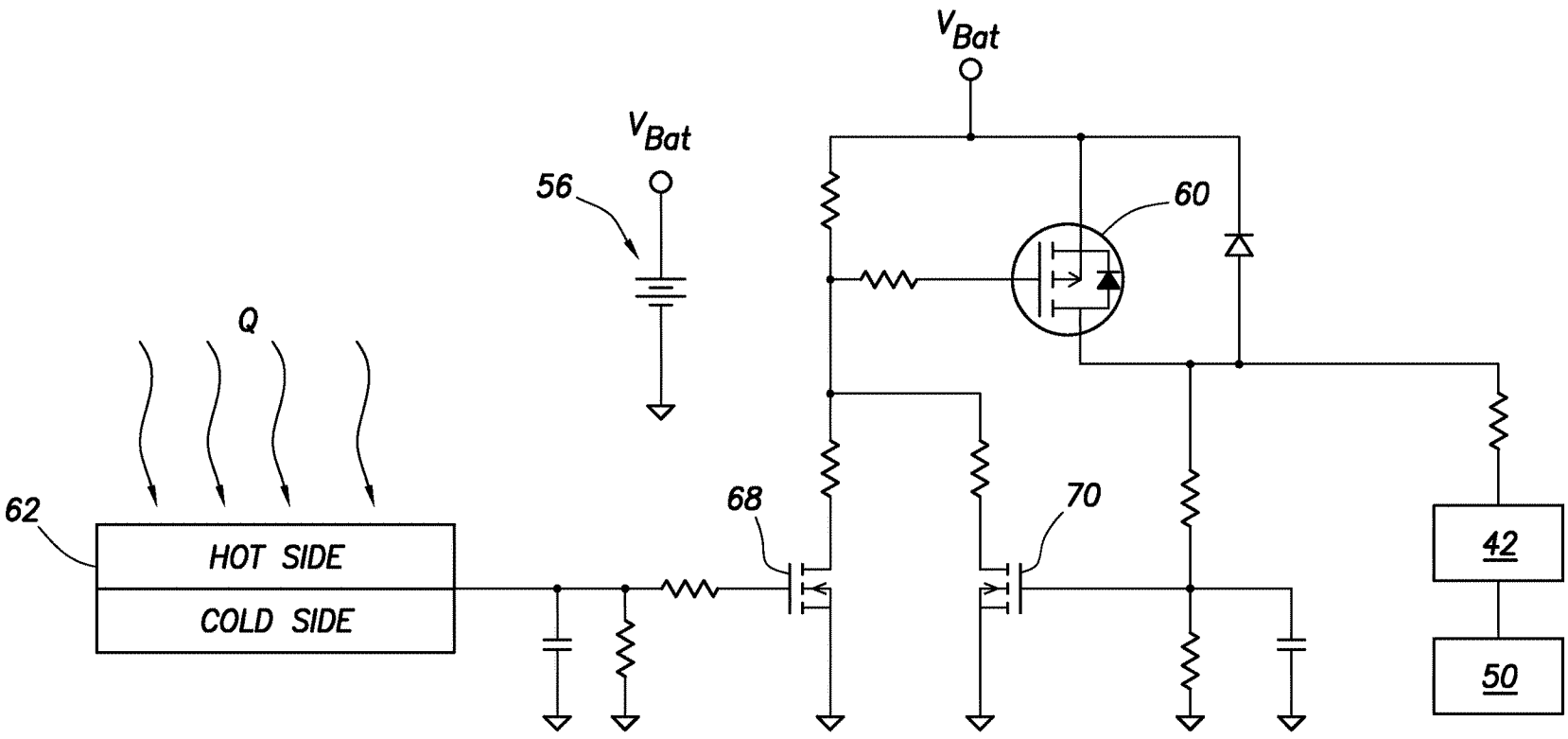
FIG. 6 is a representative circuit diagram of a switch circuit of the downhole tool.

Referring additionally now to FIG. 6, a circuit diagram for a switch circuit which may be used in the control system 34 is representatively illustrated. The generator 62 is depicted as a thermoelectric generator connected to the switch circuit. The power source 56 is depicted as a battery. However, other types of generators and power sources may be used with the switch circuit, in keeping with the principles of this disclosure.

The switch 60 is depicted in FIG. 6 as being a switching field effect transistor (FET), but other types of switching devices may be used in other examples. Another transistor 68, e.g., a metal oxide semiconductor field effect transistor (MOSFET) or an insulated gate field effect transistor (IGFET), is used to "activate" the switch 60 when electricity is generated by the generator 62 and applied to a gate of the transistor 68.

When a conducting channel is formed between a source and drain of the transistor 68 (for example, by application of a voltage from the generator 62 to the gate of the transistor), a voltage drop is created between a gate and a source of the switch 60, thereby causing a conductive channel to be formed between the source and a drain of the switch. At this point, electrical current flow between the power source 56 and the control circuitry 42 is permitted.

Another transistor 70 maintains the voltage applied to the switch 60 gate, even though the generator 62 may discontinue generating electricity. If it is desired to turn the switch 60 "off" after it has been turned "on," a reset circuit can readily be configured to selectively ground a gate of the transistor 70. This can permit testing of the switch circuit (and the control circuitry 42, sensors 40, 58, etc.) at surface, prior to installing the control system 34 in the wellbore 14.

It is not necessary for semiconductor devices as described above to be used in the switch circuit. In other examples, electromechanical devices, such as relays or latching relays, may be used.

As mentioned above, the generator 62 is depicted in FIG. 6 as being a thermoelectric generator. The thermoelectric generator generates electricity in response to a thermal gradient being applied across the generator.

In the system 10 of FIG. 1, such a thermal gradient could be produced by flowing the fluid 24 from the surface through the tubular string 12. In that case, the fluid 24 would be cooler than the environment surrounding the valves 16*a-e*.

The thermoelectric generator 62 could be positioned so that it is exposed to the relatively hot environment on one side, and to the relatively cool fluid 24 on an opposite side. For example, the thermoelectric generator 62 could be positioned in a side wall of the valve 16, such as, in a wall of the housing 30 (see FIGS. 2A & B). The annulus 20 exterior to the housing 30 would be hotter than the fluid 24 flowing through the passage 36. Of course, other positions for the generator 62 and other ways of producing a thermal gradient may be used, in keeping with the principles of this disclosure.

A phase changing material, such as a fuseable alloy, or a heat sink (not shown) could be used to maintain a consistent or larger temperature difference over a longer period of time. For example, a heat sink can be used to increase the temperature differential and, thus, to increase the electrical power generated.

Figure 7:
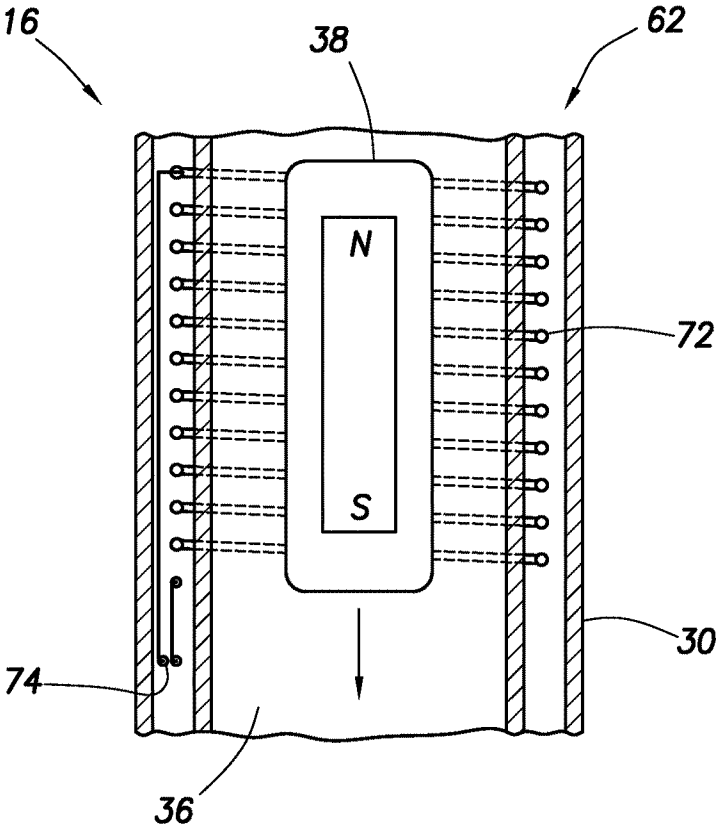
FIG. 7 is a representative cross-sectional view of an electrical generator of the downhole tool.

Referring additionally now to FIG. 7, another example of the generator 62 is representatively illustrated. In this example, the generator 62 generates electricity in response to a magnetic object or device 38 being displaced through the passage 36.

A wire coil 72 can be positioned in the housing 30 encircling the passage 36 so that, as the magnetic device 38 displaces through the coil, a voltage is produced at a terminal 74 of the coil. The terminal 74 can be connected to the switch circuit of FIG. 6 (e.g., to the gate of the transistor 68).

It may be desirable for the sensor 40 (see FIG. 5) to detect the presence of the magnetic device 38 in the passage 36, in which case the control system 34 can be designed so that the circuitry 42 monitors the sensor output immediately upon the switch 60 being turned "on" by displacement of the magnetic device through the coil 72. The actuator 50 may not be actuated immediately upon displacement of the magnetic device 38 in the passage 36, however. Instead, the magnetic device 38 may be used to switch the control system 34 of one or more downhole tools "on," so that individual downhole tools can then be selectively actuated by displacing other respective magnetic devices in the passage 36.

For example, after displacing the magnetic device 38 through the passage 36, one downhole tool could be actuated in response to displacing another corresponding magnetic device, and another downhole tool could be actuated in response to displacing yet another corresponding magnetic device, etc. The scope of this disclosure is not limited to any particular method of actuating downhole tools after the switch(es) 60 have been turned "on."

It is not necessary for the actuator 50 to cause an overt physical actuation of the downhole tool 16. Instead, activation of the tool 16 in response to the generation of electricity by the generator 62 could be in the form of, for example, initiation of data recording (e.g., as in during a formation test, a completion or conformance evaluation, etc.). Thus, activation of the downhole tool 16 can comprise supplying electrical current to any type of electrical load, in keeping with the scope of this disclosure.

Figure 8:
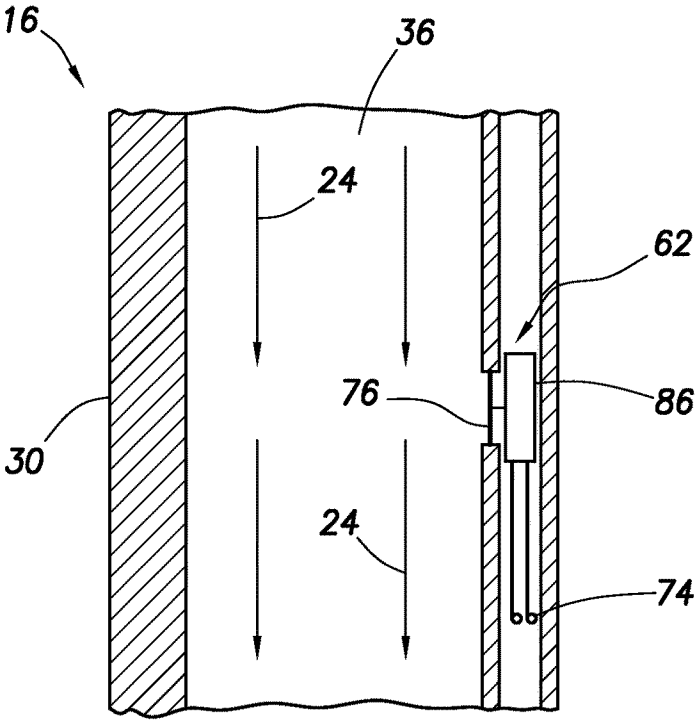
FIG. 8 is a representative cross-sectional view of another example of the electrical generator.

Referring additionally now to FIG. 8, another example of an electrical generator 62 that may be used is representatively illustrated. In this example, turbulence in the flow of the fluid 24 through the passage 36 causes vibration of a membrane 76. A piezoelectric or other electrically or magnetically active device 86 can be used to generate electricity from the membrane 76 vibration.

A "power harvester" can be used for the device 86. One suitable power harvester for use as the device 86 is a VOLTURE™ energy harvester marketed by Mide Technology of Medford, Mass. USA. Other devices which can function to generate electricity from movement or vibration may also be used.

Thus, it will be appreciated that a variety of techniques can be used to generate electricity downhole, so that the switch 60 can be turned "on" when desired. Electricity can be generated in response to flow of the fluid 24 through the passage 36 (e.g., as in the FIGS. 6 & 8 examples), in response to displacement of a magnetic device 38 in the passage (e.g., as in the FIG. 7 example), or in other ways. The scope of this disclosure is not limited to any particular method of generating electricity.

It may now be fully appreciated that the above disclosure provides significant benefits to the art of controlling activation of downhole tools. In examples described above, electrical energy can be stored downhole for extended periods of time, without being used by circuitry of downhole tools.

A method of activating a downhole tool 16 in a subterranean well is provided to the art by the above disclosure. In one example, the method can comprise: configuring the downhole tool 16 having an electrical power source 56, an electrical load (such as, an actuator 50, a downhole data gathering device, etc.), control circuitry 42 which controls activation of the electrical load, and a switch 60 which selectively permits electrical current flow between the electrical power source 56 and the control circuitry 42; and generating electricity downhole, thereby causing the switch 60 to permit the electrical current flow between the electrical power source 56 and the control circuitry 42.

The generating step can include flowing a fluid 24 downhole. The flowing step can include producing a thermal gradient at a thermoelectric generator 62 and/or producing motion at an electrical generator 62.

The fluid 24 may comprise a fracturing fluid and/or a stimulation fluid. Other types of fluid (such as, production fluid, cement, etc.) can be used.

The generating step may include displacing an object (such as, the magnetic device 38) downhole.

The method can also include, after the generating step, the control circuitry 42 causing the activation of the electrical load in response to a sensor 40 coupled to the control circuitry 42 detecting a predetermined stimulus. The stimulus could be a magnetic field, a certain number of magnetic fields, a specific magnetic field pattern, a pressure level or signal, etc. However, in some examples, the activating may be accomplished without use of a sensor to sense a predetermined stimulus.

A tool 16 for use in a subterranean well is also described above. In one example, the tool 16 can include an electrical power source 56 which stores electrical power, an electrical load, control circuitry 42 which controls activation of the electrical load, a switch 60 which selectively permits electrical current flow between the electrical power source 56 and the control circuitry 42, and an electrical generator 62.

The switch 60 may permit the electrical current flow between the electrical power source 56 and the control circuitry 42 in response to generation of electrical power by the electrical generator 62.

The tool 16 may also include a sensor 40. The control circuitry 42, in response to detection by the sensor 40 of a predetermined signal, can cause the activation of the electrical load, but only if the switch 60 permits electrical current flow between the electrical power source 56 and the control circuitry 42. The sensor 40 may comprise a magnetic field sensor.

The electrical power source 56 can comprise a battery. Other types of electrical power sources, such as charged capacitors, etc., can be used.

The electrical generator 62 may comprise a thermoelectric generator. The thermoelectric generator 62 can generate electricity in response to fluid 24 flow through a flow passage 36 of the tool 16. A thermal gradient could be produced in other ways, for example, Joule-Thomson cooling due to gas flow, setting of cement, etc. Other types of electrical generators may be used.

Another method of activating a downhole tool 16 in a subterranean well can comprise: displacing at least one of a fluid 24 and an object (such as the magnetic device 38) at the downhole tool 16 in the well, generating electricity downhole in response to the displacing, permitting electrical current flow between a downhole electrical power source 56 and a downhole control circuitry 42 in response to the generating step and, after the permitting step and in response to detection of a predetermined signal, the control circuitry 42 causing activation of a downhole electrical load (such as, the actuator 50, a heater, a data gathering device, etc.).

Causing the activation of the electrical load can include the control circuitry 42 permitting electrical current flow between the electrical power source 56 and the electrical load.

The displacing step can include producing a thermal gradient at the downhole tool 16. The displacing step can include producing movement (such as, vibration of the membrane 76) at the downhole tool 16.

If the displacing step comprises flowing the fluid 24, the fluid 24 may include a stimulation and/or a fracturing fluid. As mentioned above, other types of fluids may be used, as well.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of activating a downhole tool in a subterranean well, the method comprising:

configuring the downhole tool having an electrical power source, an electrical load, control circuitry which controls activation of the electrical load, and a switch which selectively permits electrical current flow between the electrical power source and the control circuitry;

generating electricity downhole at a generator; and applying the electricity to a transistor causing the transistor to close and exposing the switch to a voltage, thereby allowing the switch to actuate causing the switch to permit the electrical current flow between the electrical power source and the control circuitry.

2. The method of claim 1, wherein the generating further comprises flowing a fluid downhole.

3. The method of claim 2, wherein the flowing further comprises producing a thermal gradient at a thermoelectric generator.

4. The method of claim 2, wherein the flowing further comprises producing motion at an electrical generator.

5. The method of claim 2, wherein the fluid comprises a fracturing fluid.

6. The method of claim 2, wherein the fluid comprises a stimulation fluid.

7. The method of claim 1, wherein the generating further comprises displacing an object downhole.

8. The method of claim 1, further comprising:

after the generating, the control circuitry causing activation of the electrical load in response to a sensor coupled to the control circuitry detecting a predetermined stimulus.

9. A tool for use in a subterranean well, the tool comprising:

an electrical power source which stores electrical power;

an electrical load;

control circuitry which controls activation of the electrical load;

a switch which selectively permits electrical current flow between the electrical power source and the control circuitry;

a transistor; and an electrical generator, wherein the transistor closes when electricity generated by the electrical generator is applied to the transistor, thereby exposing the switch to a voltage and allowing the switch to actuate; and wherein the switch permits the electrical current flow between the electrical power source and the control circuitry in response to generation of electrical power by the electrical generator.

10. The tool of claim 9, further comprising a sensor, and wherein the control circuitry, in response to detection by the sensor of a predetermined signal, causes activation of the electrical load, only if the switch permits the electrical current flow between the electrical power source and the control circuitry.

11. The tool of claim 10, wherein the sensor comprises a magnetic field sensor.

12. The tool of claim 9, wherein the electrical power source comprises a battery.

13. The tool of claim 9, wherein the electrical generator comprises a thermoelectric generator.

14. The tool of claim 13, wherein the thermoelectric generator generates electricity in response to fluid flow through a flow passage of the tool.

15. A method of activating a downhole tool in a subterranean well, the method comprising:

displacing at least one of a fluid and an object at the downhole tool in the well;

generating electricity at a generator downhole in response to the displacing;

permitting electrical current flow via a switch between a downhole electrical power source and a downhole control circuitry in response to the generating, wherein a transistor closes in response to electricity being applied to the transistor, thereby exposing the switch to a voltage and allowing the switch to actuate; and after the permitting and in response to detection of a predetermined signal, the control circuitry causing activation of a downhole electrical load.

16. The method of claim 15, wherein the activation further comprises the control circuitry permitting the electrical current flow between the electrical power source and the electrical load.

17. The method of claim 15, wherein the displacing further comprises producing a thermal gradient at the downhole tool.

18. The method of claim 15, wherein the displacing further comprises producing movement at the downhole tool.

19. The method of claim 15, wherein the displacing comprises flowing the fluid, and wherein the fluid comprises at least one of a stimulation and a fracturing fluid.

* * * * *